US010975757B2

(12) United States Patent
Cho et al.

(10) Patent No.: US 10,975,757 B2
(45) Date of Patent: Apr. 13, 2021

(54) CONTROL SYSTEM FOR VEHICLE

(71) Applicants: Hyundai Motor Company, Seoul (KR); Kia Motors Corporation, Seoul (KR)

(72) Inventors: Jae Man Cho, Seoul (KR); Kwang Sik Yang, Gunpo-si (KR); Jongmin Kim, Seoul (KR); Woo Yong Lee, Hwaseong-si (KR); Kyounghee Kim, Ansan-si (KR); Jung Hoon Park, Anyang-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 9 days.

(21) Appl. No.: 16/211,643

(22) Filed: Dec. 6, 2018

(65) Prior Publication Data

US 2019/0186340 A1 Jun. 20, 2019

(51) Int. Cl.

| | |
|---|---|
| ***F01P 7/16*** | (2006.01) |
| ***F01P 3/02*** | (2006.01) |
| ***F02M 26/33*** | (2016.01) |
| ***F02M 26/28*** | (2016.01) |

(52) U.S. Cl.

CPC ..... *F01P 7/167* (2013.01); *F01P 3/02* (2013.01); *F02M 26/28* (2016.02); *F02M 26/33* (2016.02)

(58) Field of Classification Search

CPC ..... F01P 7/167; F01P 3/02; F01P 7/14; F01P 5/10; F01P 3/20; F01P 11/00; F01P 2007/146; F01P 2050/22; F02M 26/28; F02M 26/33; F02F 1/02; F02F 1/10; F02F 1/26; F02F 1/36

See application file for complete search history.

(56) References Cited

U.S. PATENT DOCUMENTS

| | | | | |
|---|---|---|---|---|
| 8,701,603 | B2 * | 4/2014 | Warnery | F01P 7/167 123/41.08 |
| 2015/0361865 | A1 * | 12/2015 | Lee | F01P 7/14 123/41.08 |
| 2015/0377114 | A1 * | 12/2015 | Matsumoto | F02F 1/14 123/41.44 |
| 2016/0010533 | A1 * | 1/2016 | Matsumoto | F01P 3/02 123/41.08 |
| 2016/0084143 | A1 * | 3/2016 | Lee | F01P 7/165 123/41.08 |
| 2017/0058753 | A1 * | 3/2017 | Lee | F01P 7/14 |

(Continued)

FOREIGN PATENT DOCUMENTS

JP 2015-059615 A 3/2015

*Primary Examiner* — Grant Moubry

(74) *Attorney, Agent, or Firm* — Morgan, Lewis & Bockius LLP

(57) ABSTRACT

A cooling system may include a cylinder block; an exhaust gas recirculation (EGR) cooler that receives some of a coolant of the cylinder block and transmits the received coolant back to the cylinder block; a cylinder head that receives a coolant from the cylinder block; a thermal management module that selectively transmits the coolant received from the cylinder head to a plurality of coolant lines; a water pump that transmits the coolants transmitted from the plurality of coolant lines to the cylinder block; and a controller that is connected to the thermal management module and configured to control operation of the thermal management module.

14 Claims, 3 Drawing Sheets

(56) References Cited

U.S. PATENT DOCUMENTS

| | | | | |
|---|---|---|---|---|
| 2017/0096930 | A1* | 4/2017 | Murai | F01P 3/02 |
| 2017/0107891 | A1* | 4/2017 | Murai | F01P 3/02 |
| 2017/0292435 | A1* | 10/2017 | Toyama | F01P 11/16 |
| 2018/0051620 | A1* | 2/2018 | Lee | F02M 26/32 |
| 2018/0245503 | A1* | 8/2018 | Toyama | F01P 7/16 |
| 2018/0245504 | A1* | 8/2018 | Murai | F01P 3/02 |
| 2018/0266304 | A1* | 9/2018 | Toyama | F01P 3/02 |
| 2019/0078494 | A1* | 3/2019 | Lee | F01P 7/14 |
| 2019/0120121 | A1* | 4/2019 | Lee | F01P 3/02 |

* cited by examiner

CONTROL SYSTEM FOR VEHICLE

CROSS-REFERENCE TO RELATED APPLICATION

The present application claims priority to Korean Patent Application No. 10-2017-0175989 filed on Dec. 20, 2017, the entire contents of which is incorporated herein for all purposes by this reference.

BACKGROUND OF THE INVENTION

Field of the Invention

The present invention relates to a cooling system for improving warm-up and cooling performance by controlling a coolant flowing to each of engine parts depending on a driving condition.

Description of Related Art

An engine exhausts thermal energy while generating torque by combustion of fuel, and the coolant absorbs the thermal energy while circulating through the engine, a heater, a radiator, and the like and discharges the absorbed thermal energy to the outside.

When a coolant temperature of the engine is low, oil viscosity is increased and thus a frictional force is increased, fuel consumption is increased, time for activating a catalyst is increased since a temperature of an exhaust gas is slowly increased, and quality of the exhaust gas deteriorates. Furthermore, time for normalization of heater functions is increased, causing discomfort to a user.

When the coolant temperature of the engine is excessively increased, knocking is caused and thus ignition timing is adjusted to suppress the generation of knocking, and accordingly performance of the engine may deteriorate, and when lubricant is excessively heated, lubrication performance may deteriorate.

Accordingly, a coolant control valve that controls several cooling elements through one valve unit may be applied to maintain the temperature of the coolant in a specific portion of the engine to be high and maintain the coolant temperature of other portions of the engine to be low.

A method for a single heat management module controls a coolant that flows through a radiator, a heater core, an exhaust gas recirculation (EGR) cooler, an oil cooler, or a cylinder block has been researched and developed. As a related art, there is Japanese unexamined patent publication No. 2015-59615.

The information included in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a cooling system for a vehicle that can provide efficient cooling and prompt warm-up with a simple structure.

A cooling system may include a cylinder block; an exhaust gas recirculation (EGR) cooler that receives some of a coolant of the cylinder block and transmits the received coolant back to the cylinder block; a cylinder head that receives a coolant from the cylinder block; a thermal management module that selectively transmits the coolant received from the cylinder head to a plurality of coolant lines; a water pump that transmits the coolants transmitted from the plurality of coolant lines to the cylinder block; and a controller that is connected to the thermal management module and configured to control operation of the thermal management module.

The controller may be configured to control the thermal management module with a predetermined plurality of operation modes based on operation information that may include a coolant temperature and an outdoor temperature.

The plurality of coolant lines may include: a first coolant line that passes through a heater; a second coolant line that passes through a radiator; and a third coolant line that passes through a heat exchanger.

The plurality of operation modes may control the opening amount of the first coolant line while closing the second coolant line and the third coolant line.

The plurality of operation modes may include a stop mode that closes all of the first, second, and third coolant lines.

The plurality of operation modes may include a heat exchange mode in which the opening amount of the third coolant line is controlled while closing the first coolant line and the second coolant line.

The plurality of operation modes may include a heater control mode in which the opening amount of the first coolant line is controlled while the second coolant line is closed and the third coolant line is opened.

The plurality of operation modes may include a coolant temperature control mode in which the opening amount of the second coolant line is controlled while the first coolant line and the third coolant line are opened.

A cooling system may include a cylinder block; an exhaust gas recirculation (EGR) cooler that receives some of a coolant of the cylinder block and transmits the received coolant back to the cylinder block; an exhaust gas recirculation (EGR) cooler that receives some of a coolant of the cylinder block and transmits the received coolant back to the cylinder block; a thermal management module that selectively transmits a coolant received from the cylinder head to a first coolant line that passes through a heater, a second coolant line that passes through a radiator, and a third coolant line that passes through a heat exchanger; a water pump that transmits the coolants transmitted from the plurality of coolant lines to the cylinder block; and a controller that is configured to control operation of the thermal management module based on operation information that may include a coolant temperature and an outdoor temperature.

The controller may operate a heating mode in which the opening amount of the first coolant line is controlled while the second coolant line and the third coolant line are closed by controlling operation of the thermal management module.

The controller may operate a stop mode in which the first coolant line, the second coolant line, and the third coolant line are all closed by controlling operation of the thermal management module.

The controller may operate a heat exchange mode in which the opening amount of the third coolant line is controlled while the first coolant line and the second coolant line are closed by controlling operation of the thermal management module.

The controller may operate a heater control mode in which the opening amount of the first coolant line is controlled while the second coolant line is closed and the third coolant line is opened by controlling operation of the thermal management module.

The controller may operate a coolant temperature control mode in which the opening amount of the second coolant line is controlled while the first coolant line and the third coolant line are opened by controlling operation of the thermal management module.

According to the exemplary embodiments of the present invention, a cooling system for the vehicle, which can improve cooling efficiency and carry out prompt warm-up conducted with a simple structure, may be provided.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
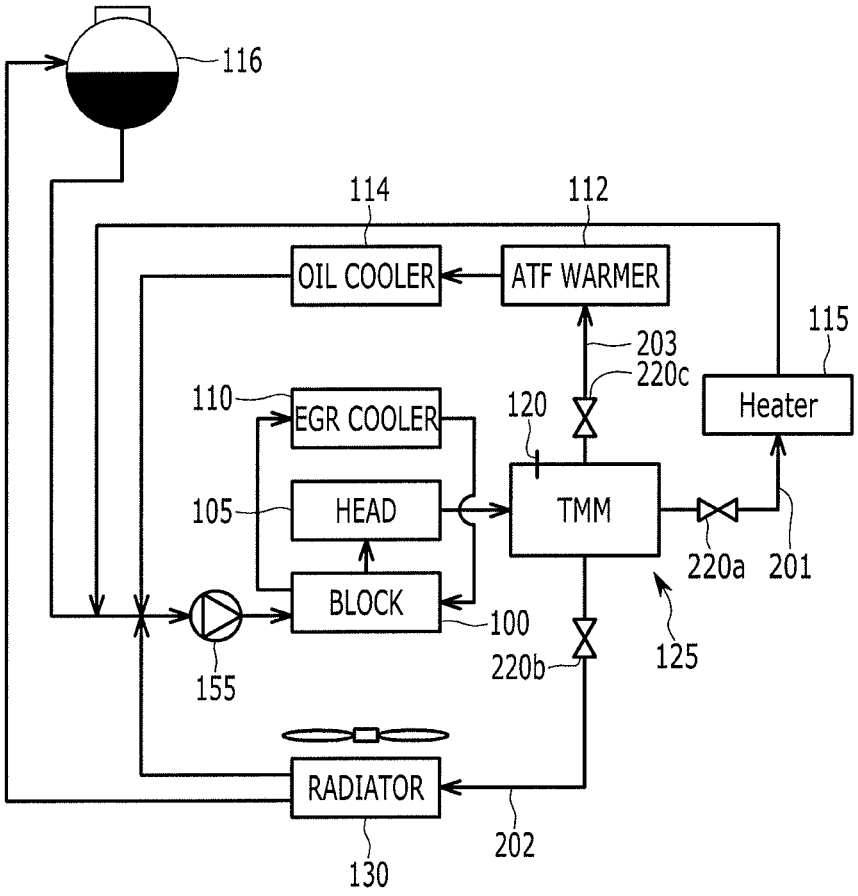
FIG. 1 is a schematic diagram of a cooling system according to an exemplary embodiment of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Hereinafter, an exemplary embodiment of the present invention will be described in detail with reference to the accompanying drawings.

However, parts which are not related with the description are omitted for clearly describing the exemplary embodiment of the present invention, and like reference numerals refer to like or similar elements throughout the specification.

In the following description, dividing names of components into first, second, and the like is to divide the names because the names of the components are the same as each other, and an order thereof is not particularly limited.

Figure 2:
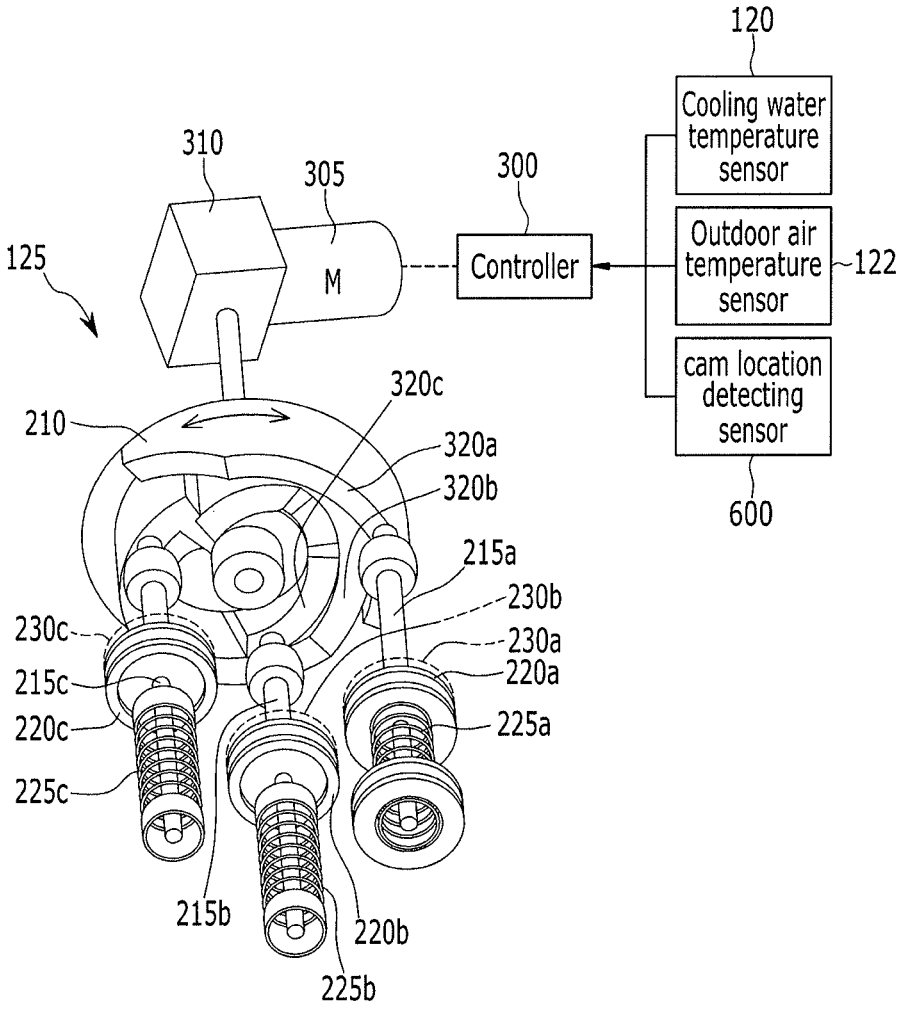
FIG. 2 is a partial perspective view of a heat management module which may be applied to the cooling system according to the exemplary embodiment of the present invention.

FIG. 1 is a schematic diagram of a cooling system according to an exemplary embodiment of the present invention, and FIG. 2 is a partial perspective view of a heat management module which may be applied to the cooling system according to the exemplary embodiment of the present invention.

Referring to FIG. 1 and FIG. 2, a cooling system according to an exemplary embodiment of the present invention includes a cylinder block 100, an exhaust gas recirculation (EGR) cooler 110 that receives some of a coolant from the cylinder block 100 and transmits the received coolant back to the cylinder block 100, a cylinder head 105 that receives a coolant from the cylinder block 100, a thermal management module (TMM) 125 that selectively transmits the coolant received from the cylinder head 105 to a plurality of coolant lines, a water pump 155 that transmits the coolant transmitted from the plurality of coolant lines to the cylinder block 100, and a controller 300 that controls operation of the TMM 125.

The controller 300 controls the TMM 125 with a predetermined plurality of operation modes based on operation information that includes a coolant temperature and an outdoor temperature transmitted from a coolant temperature sensor 120 and an outdoor air temperature sensor 122.

The plurality of coolant lines may include a first coolant line 201 that passes through a heater 115, a second coolant line 202 that passes through a radiator 130, and a third coolant line 203 that passes through a heat exchanger.

The heat exchanger may be, for example, an oil cooler 114 and/or an auto transmission fluid (ATF) warmer 112.

The coolant line may be simplified since the exhaust gas recirculation (EGR) cooler 110 does not control cooling by use of an additional control valve and the like.

When a relatively cold coolant and a relatively high-temperature exhaust gas are simultaneously supplied to the EGR cooler 110, condensation may occur.

However, in the exemplary embodiment of the present invention, a coolant flow of the cylinder block 100 is delayed at a state of cooling, and a coolant flow toward the EGR cooler 110 is also delayed. Accordingly, the possibility of exhaust gas condensation due to flow of a relatively cold coolant may be suppressed.

Furthermore, when the coolant is supplied to the cylinder block 100, a temperature of the EGR cooler 110 may be maintained at a predetermined temperature since the EGR cooler 110 and the cylinder block 100 are always connected to each other, and accordingly, the coolant in the EGR cooler 110 may be suppressed from being locally (partially) vaporized, assuring durability of the EGR cooler 110.

That is, when a coolant flow of the cylinder block 100 is delayed, a coolant flow toward the EGR cooler 110 is also delayed, and accordingly, the possibility of exhaust gas condensation due to flow of a relatively cold coolant may be prevented.

An additional coolant line is branched from the second coolant line 202 that passes through the radiator 130 and thus may pass through a reservoir tank 116.

Referring to FIG. 2, the TMM 125 includes a cam 210, a track formed in the cam 210, a rod that contacts the track, a valve which is combined to the rod, and an elastic member that elastically supports the valve, and the valve opens and closes a coolant path.

A plurality of tracks, for example, a first track 320*a*, a second track 320*b*, and a third track 320*c*, each having a predetermined inclination and height, and a plurality of rods, for example, a first rod 215*a*, a second rod 215*b*, and a third rod 215*c*, are provided in a lower portion of the cam 210 such that the first, second, and third rods 215*a*, 215*b*, and 215*c* that, respectively contact the first, second, and third tracks 320*a*, 320*b*, and 320*c* can move downward depending on a rotation position of the cam 210. Furthermore, the elastic member includes three elastic members, i.e., a first elastic member 225*a*, a second elastic member 225*b*, and a third elastic member 225*c* to respectively elastically support the first, second, and third rods 215*a*, 215*b*, and 215*c*.

While the first, second, and third elastic members 225*a*, 225*b*, and 225*c* are compressed depending on the rotation position of the cam 210, a first valve 220*a*, a second valve 220*b*, and a third valve 220*c* respectively mounted to the first, second, and third rods 215*a*, 215*b*, and 215*c* open or close a first coolant path 230*a*, a second coolant path 230*b*, and a third coolant path 230*c*. Here, an opening amount of each of the respective coolant paths may be controlled depending on a rotation position of the cam 210.

The controller 300 controls a motor 305 by use of operation conditions (e.g., a coolant temperature, an outdoor temperature, and the like) and a location of the cam 210 received from a cam location detecting sensor 600, and the motor 305 changes the rotation position of the cam 210 using a gear box 310.

The cam location detecting sensor 600 may be a sensor that directly detects a rotation position of the cam 210, and the controller 300 may indirectly determine the rotation position of the cam 210 by detecting a rotation portion of the motor 305 through a resolver.

The first coolant path 230*a* is connected to the first coolant line 210 that passes through the heater 115, the second coolant path 230*b* is connected to the second coolant line 202 that passes through the radiator 130, and the third coolant path 230*c* is connected to the third coolant line 203 that passes through the heat exchanger.

The control unit 320 may be at least one microprocessor operated by a predetermined program which may include a series of commands for carrying out a method in accordance with various exemplary embodiments of the present invention.

The thermal management module according to the exemplary embodiment of the present invention is not limited to the TMM 125 shown in FIG. 2, and a thermal management module having any known structure that can open or close at least three coolant paths is applicable.

Figure 3:
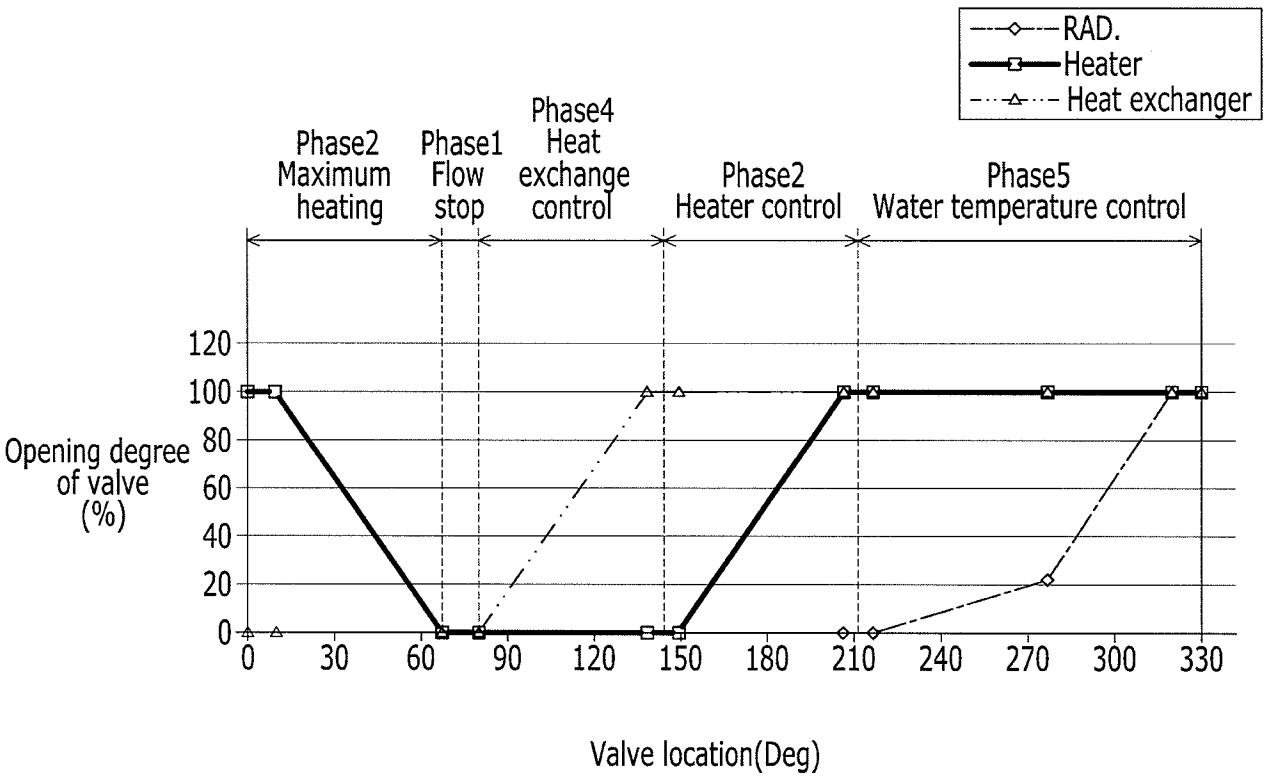
FIG. 3 is a graph that shows an operation mode of the cooling system according to the exemplary embodiment of the present invention.

FIG. 3 is a graph illustrating operation modes of the cooling system according to the exemplary embodiment of the present invention.

Referring to FIG. 3, each of the operation modes of the cooling system according to the exemplary embodiment of the present invention will be described.

In FIG. 3, the horizontal axis denotes a rotation position of the cam 210, and the vertical axis denotes opening amounts of the respective valves 220*a*, 220*b*, and 220*c*.

The controller 300 operates a heating mode (i.e., Phase 3) that controls the opening amount of the first coolant line 201 while closing the second and third coolant lines 202 and 203 by controlling operation of the TMM 125.

When heating is required, a coolant may be controlled to flow only to the heater 115. That is, when the coolant temperature and the outdoor temperature are lower than a predetermined temperature, the second and third coolant paths 202 and 203 are closed and the first coolant path 201 connected to the heater 115 is opened to enhance heater performance.

The controller 300 may operate a stop mode (i.e., Phase 1) in which the first, second, and third coolant lines 201, 202, and 203 are closed by controlling operation of the TMM 125.

In the stop mode, the flow of the coolant is stopped to perform fast warm-up. That is, an engine temperature is increased as fast as possible to improve fuel efficiency and suppress generation of noxious exhaust gas.

In the instant case, a coolant flow to the EGR cooler may be blocked without forming an additional valve so that condensation of the exhaust gas due to a cold coolant may be suppressed.

The controller 300 may operation a heat exchange mode (i.e., Phase 4) in which an opening amount of the third coolant line 203 is controlled while the first and second coolant lines 201 and 202 are closed by controlling operation of the TMM 125.

In the heat exchange mode, flow stop is released and then warm-up is conducted until reaching a target coolant temperature. That is, when a coolant is applied to the heat exchanger, and a temperature of the coolant may be smoothly increased to the target coolant temperature while suppressing a sudden change in the coolant temperature, and time taken for warm-up may be reduced.

The controller 300 may operate a heater control mode (i.e., Phase 2) in which the opening amount of the first coolant line 201 is controlled while closing the second coolant line 202 and opening the third coolant line 203 by controlling operation of the TMM 125.

In the heater control mode, the coolant is simultaneously supplied to the heater 115 and the heat exchanger.

The controller 300 may operate a coolant temperature control mode (i.e., Phase 5) in which the opening amount of the second coolant line 202 is controlled while the first and third coolant lines 201 and 203 are opened by controlling the operation of the TMM 125.

According to the cooling system for the vehicle according to the exemplary embodiment of the present invention, cooling efficiency may be improved and prompt warm-up may be conducted with a simple structure.

Since no additional control valve for cooling the EGR cooler is needed, a coolant line may be simplified.

The cooling system for the vehicle according to the exemplary embodiment of the present invention can realize various cooling modes by controlling the thermal management module.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A cooling system comprising:

a cylinder block;

an exhaust gas recirculation (EGR) cooler fluidically connected to the cylinder block and configured for receiving a portion of a coolant of the cylinder block and transmitting the received coolant back to the cylinder block;

a cylinder head fluidically connected to the cylinder block and receiving the coolant from the cylinder block;

a thermal management module (TMM) fluidically connected to the cylinder head and a plurality of coolant lines and configured for selectively transmitting the coolant received from the cylinder head to the plurality of coolant lines;

a water pump fluidically connected to the cylinder block and the plurality of coolant lines and configured for transmitting the coolant transmitted from the plurality of coolant lines to the cylinder block; and a controller that is connected to the thermal management module and configured to control operation of the thermal management module, wherein the EGR cooler is directly and fluidically connected to the cylinder block, wherein the cylinder head receives the coolant directly from the cylinder block;

wherein the thermal management module is directly and fluidically connected to the cylinder head, wherein the water pump is directly and fluidically connected to the cylinder block, wherein the controller is configured to control the thermal management module with a plurality of operation modes based on operation information that includes a coolant temperature and an outdoor temperature, wherein the plurality of coolant lines includes:

a first coolant line that passes through a heater;

a second coolant line that passes through a radiator; and a third coolant line that passes through a heat exchanger, and wherein the plurality of operation modes includes a heat exchange mode in which an opening amount of the third coolant line is controlled while closing the first coolant line and the second coolant line.

2. The cooling system of claim 1, wherein the TMM includes:

an actuator connected to the controller;

a cam connected to the actuator;

a plurality of tracks formed in the cam;

a plurality of rods contacting the plurality of tracks;

a plurality of valves connected to the plurality of rods and selectively opening the first, second, and third coolant lines; and a plurality of elastic members that elastically supports the plurality of valves.

3. The cooling system of claim 2, wherein the plurality of tracks includes a first track, a second track, and a third track, each having a predetermined inclination and height, wherein the plurality of rods includes a first rod, a second rod, and a third rod which are provided in a lower portion of the cam such that the first, second, and third rods contact the first, second, and third tracks, respectively, wherein the plurality of the elastic members include a first elastic member, a second elastic member, and a third elastic member to elastically support the first, second, and third rods, respectively, the first, second, and third elastic members compressed depending on a rotation position of the cam, and wherein the plurality of valves includes a first valve, a second valve, and a third valve mounted to the first, second, and third rods, respectively, to selectively open a first coolant path connected to the first coolant line, a second coolant path connected to the second coolant line, and a third coolant path connected to the third coolant line, respectively.

4. The cooling system of claim 1, wherein the plurality of operation modes is configured to control an opening amount of the first coolant line while closing the second coolant line and the third coolant line.

5. The cooling system of claim 1, wherein the plurality of operation modes includes a stop mode that closes all of the first, second, and third coolant lines.

6. The cooling system of claim 1, wherein the plurality of operation modes includes a heater control mode in which an opening amount of the first coolant line is controlled while the second coolant line is closed and the third coolant line is opened.

7. The cooling system of claim 1, wherein the plurality of operation modes includes a coolant temperature control mode in which an opening amount of the second coolant line is controlled while the first coolant line and the third coolant line are opened.

8. A cooling system comprising:

a cylinder block;

an exhaust gas recirculation (EGR) cooler fluidically connected to the cylinder block and configured for receiving a portion of a coolant of the cylinder block and transmitting the received coolant back to the cylinder block;

a cylinder head fluidically connected to the cylinder block and configured to receive the coolant from the cylinder block;

a thermal management module (TMM) fluidically connected to the cylinder head and first, second, and third coolant lines and configured for selectively transmitting the coolant received from the cylinder head to the first coolant line that passes through a heater, the second coolant line that passes through a radiator, and the third coolant line that passes through a heat exchanger;

a water pump fluidically connected to the cylinder block and the first, second, and third coolant lines and configured for transmitting the coolant transmitted from the first, second, and third coolant lines to the cylinder block; and a controller that is configured to control operation of the thermal management module based on operation information that includes a coolant temperature and an outdoor temperature, wherein the EGR cooler is directly and fluidically connected to the cylinder block, wherein the cylinder head receives the coolant directly from the cylinder block;

wherein the thermal management module is directly and fluidically connected to the cylinder head, wherein the water pump is directly and fluidically connected to the cylinder block, and wherein the controller is configured to operate a heat exchange mode in which an opening amount of the third coolant line is controlled while the first coolant line and the second coolant line are closed by controlling operation of the thermal management module.

9. The cooling system of claim 8, wherein the TMM includes:

an actuator connected to the controller;

a cam connected to the actuator;

a plurality of tracks formed in the cam;

a plurality of rods contacting the plurality of tracks;

a plurality of valves connected to the plurality of rods and selectively opening the first, second, and third coolant lines; and a plurality of elastic members that elastically supports the plurality of valves.

10. The cooling system of claim 9, wherein the plurality of tracks includes a first track, a second track, and a third track, each having a predetermined inclination and height, wherein the plurality of rods includes a first rod, a second rod, and a third rod which are provided in a lower portion of the cam such that the first, second, and third rods contact the first, second, and third tracks, respectively, wherein the plurality of the elastic members include a first elastic member, a second elastic member, and a third elastic member to elastically support the first, second, and third rods, respectively, the first, second, and third elastic members compressed depending on a rotation position of the cam, and wherein the plurality of valves includes a first valve, a second valve, and a third valve mounted to the first, second, and third rods, respectively, to selectively open a first coolant path connected to the first coolant line, a second coolant path connected to the second coolant line, and a third coolant path connected to the third coolant line, respectively.

11. The cooling system of claim 8, wherein the controller is configured to operate a heating mode in which an opening amount of the first coolant line is controlled while the second coolant line and the third coolant line are closed by controlling operation of the thermal management module.

12. The cooling system of claim 8, wherein the controller is configured to operate a stop mode in which the first coolant line, the second coolant line, and the third coolant line are all closed by controlling operation of the thermal management module.

13. The cooling system of claim 8, wherein the controller is configured to operate a heater control mode in which an opening amount of the first coolant line is controlled while the second coolant line is closed and the third coolant line is opened by controlling operation of the thermal management module.

14. The cooling system of claim 8, wherein the controller is configured to operate a coolant temperature control mode in which an opening amount of the second coolant line is controlled while the first coolant line and the third coolant line are opened by controlling operation of the thermal management module.

* * * * *